United States Patent [19]

Horodysky et al.

[11] Patent Number: 4,960,529

[45] Date of Patent: Oct. 2, 1990

[54] DIACYL HALIDES WITH AMINES AND PHOSPHITES AS MULTIFUNCTIONAL LUBRICANT ADDITIVES

[75] Inventors: Andrew G. Horodysky, Cherry Hill, N.J.; Shi-Ming Wu, Newtown, Pa.

[73] Assignee: Mobil Oil Corporation, New York, N.Y.

[21] Appl. No.: 406,474

[22] Filed: Sep. 13, 1989

[51] Int. Cl.[5] ..... C10M 109/00

[52] U.S. Cl. ..... 252/32.5

[58] Field of Search ..... 252/32.5, 51.5 A, 46.6, 252/51.5 R, 54

[56] References Cited

U.S. PATENT DOCUMENTS 4,338,205 7/1982 Wisotsky ..... 252/325

FOREIGN PATENT DOCUMENTS 1090804 4/1959 Fed. Rep. of Germany ..... 252/32.5
0173097 9/1985 Japan ..... 252/32.5
1168592 7/1985 U.S.S.R. ..... 252/32.5

*Primary Examiner*—Olik Chaudhuri
*Assistant Examiner*—James M. Hunter, Jr.
*Attorney, Agent, or Firm*—Alexander J. McKillop; Charles J. Speciale; Howard M. Flournoy

[57] ABSTRACT

The reaction product of diacyl generating species, hydrocarbyl amines and diaryl phosphites are effective EP/antiwear and antioxidant additives in lubricating oils, greases and functional fluids.

37 Claims, No Drawings

DIACYL HALIDES WITH AMINES AND PHOSPHITES AS MULTIFUNCTIONAL LUBRICANT ADDITIVES

BACKGROUND OF THE INVENTION

This application is directed to novel reaction products of diacyl halides with amines and phophites which function as multifaceted additives when incporated into lubricants and to lubricant compositions containing same.

Lubricants, such as lubricating oils and greases, are subject to oxidative deterioration at elevated temperatures or upon prolonged exposure to the elements. Such deterioration is evidenced, in many instances, by an increase in acidity and in viscosity. When the deterioration is severe enough, it can cause metal parts to corrode. Additionally, severe oxidation leads to a loss of lubrication properties, and in especiallly severe cases this may cause complete breakdown of the device being lubricated. Many additives have been tried and many of them are only marginally effective except at high concentrations. Improved antioxidants are clearly needed.

Antioxidants or oxidation inhibitors are used to minimize the effect of oil deterioration that occurs when hot oil is contatced with air. The degree and rate of oxidation will depend on temperature, air and oil flow rates and, of particularl importance, on the presence of metals that may catalytically promote oxidation. Antioxidants generally function by prevention of chain perioxide reaction and/or metal catalyst deactivation. They prevent the formation of acid sludges, darkening of the oil and increases in visosity due to the formation of polymerica materials. Additionally lubricants are under heavy stress that can affect their antiwear and load carrying ability particularly between steel on steel moving surfaces.

The use of phosphorous compounds per se as load-carrying or EP additives in lubricant compositions is well known. Also, the use of sulfur-containing compounds in lubricant compositions is well known. However the instant combination of acyl group and phosphorous containing species with amines to form unique compositions to the best of applicant's knowledge was heretofore unknown.

It is an object of this invention to provide lubricant compositions having enchanced oxidative stability, reduced wear and increased load carrying/EP capabilities.

SUMMARY OF THE INVENTION

This invention is directed to the use of reaction products of diacyl halides with alkyl/aryl amines and organic diaryl phosphites as multifunctional additives in lubricant compositions containing such additives to improve their performance properties, the reaction products per se and to lubricant compositions containing same.

DESCRIPTION OF PREFERRED EMBODIMENTS

Diacyl halides, e.g., chlorides, usable herein can be prepared from aliphatic dicarboxylic acids and/or diesters with inorganic acid halides. In general, terminal dicarboxylic acids/diesters are preferably reacted with inorganic acid halides such as thionyl chloride. However, the preparation is not limited in diacyl chlorides. In general diacyl halides or other suitable diacyl-forming species are suitable as the core moiety to couple with amines and phosphites. Any acyl-type group capable of reacting in the described manner can be used effectively as diacyl generating species.

The diacyl halides can also be coupled with aromatic dicarboxylic acids if so desired. However, aliphatic dicarboxylic acids are preferred, the aliphatic moiety can contain as little as 0 carbon atoms. Preferred acids include 1,10-decanedicarboxylic acid and 1,8-octanedicarboxylic acid or mixtures thereof. The diacyl halides useful herein have the following generalized formula:

$$X-\overset{\overset{\displaystyle O}{\|}}{C}-R-\overset{\overset{\displaystyle O}{\|}}{C}-X$$

where X is halide, e.g., fluoride, chloride, bromide or iodide, preferably chloride. R is preferably aliphatic having from about 0 to about 80 carbon atoms, preferably from 4 to about 32 carbon atoms, and can optionally contain sulfur oxygen and/or nitrogen.

Suitable amines include primary and secondary aliphatic and aromatic amines, alkyl-aryl amines, aryl-alkyl amines, alkoxylated and/or polyalkoxylated aliphatic amines and the like. Preferred are such aliphatic amines as oleylamine or cocoamine and such aryl amines as Vanlube NA products (alkylated diphenylamines) of R. T. Vanderbilt, Norwalk, Conn. The amines generally contain from about 6 to 60 carbon atoms.

Any suitable aryl phosphite can be used in the invention, preferred are diaryl phosphites. They may be obtained commercially or prepared in any convenient manner known in the art. For example, the diaryl phosphites can be prepared from the reaction of phenols-/alkylated phenols. phosphorous trichloride, and water. Preferred are phosphites such as di(nonylphenyl) phosphite.

The incorporation of phenolic phosphites and alkyl-/aryl amines onto the backbone of aliphatic diacyl halides provides the basis for unique internal synergistic antioxidant, extreme pressure/antiwear activity, and enhanced lubricity. These additives are readily prepared in a one-pot, two-step process.

Generally speaking (1) a dicarboxylic acid, such as 1,10-decanedicaroxylic acid, is reacted in molar ratios varying from 3:1 to 1:3 moles preferably 1:2 to 1:2.5 of acid to a halogenating agent such as $SOCL_2$ or $SOBr_2$ under ambient pressure at temperatures varying from about 0° C. to about 120° C. preferably 0° C. to 70° C. until the diacyl halide is obtained and (2) reacting the diacyl halide with an equal molar ratio of diaryl phosphite and amine to obtain the desired additive product. However, up to 200% excess of phosphite and/or amine can be used or less than molar amounts of phosphite and/or amine can be used, often as little at 20% of stoichiometric amounts. A solvent may be used if desired. Any suitable hydrocarbon solvent such as toluene, benzene, xylene, cyclohexane, and the like may be used, if any. When a solvent is used, it should be one in which the products are soluble and which can be relatively easily removed, although in some cases a lubricating oil can be used as a solvent and diluent. Step two will generally be run at the temperature of reflux. The temperature, however, is not believed to be critical and can vary over a wide range of from about 10° to about 225° C.

Times of reaction are not critical, but they will vary depending upon the size and complexity of the reactants. Under normal conditions, the reaction with the contemplated reactants can be completed in from about one hour to about ten hours, preferably from about two hours to about six hours.

Other additives, such as detergents, dispersants, antioxidants, antiwear agents, extreme pressure additives, pour depressants, antirust additives and the like may be present in the composition. These can include metallic or non-metallic phenates, sulfonates, polymeric succinimides, zinc dialkyl or aryl dithiophosphates, polymers, calcium and magnesium salts, polymeric viscosity index improving additives such as olefin copolymers, sulfurized olefins and the like.

The compounds of the invention are used with lubricating oils or greases to the extent of from about 0.01% to about 10% by weight of the total composition, preferably from about 0.2% to about 3%.

The lubricants contemplated for use with the novel additives herein disclosed include mineral and synthetic hydrocarbon oils of lubricating viscosity, mixtures of mineral oils and synthetic oils and greases from any of these, including the mixtures. The synthetic hydrocarbon oils include long chain alkanes such as centanes and olefin polymers such as oligomers of hexene, octene, decene and dodecene, etc. The other synthetic oils, which can be used alone with this invention, or which can be mixed with a mineral or synthetic hydrocarbon oil, include (1) fully esterified ester oils, with no free hydroxyls, such as pentaerythritol esters of monocarboxylic acids having 2 to 20 carbon atoms, trimethylolpropane esters of monocarboxylic acids having 2 to 20 carbon atoms, (2) polyacetals and (3) siloxane fluids. Especially useful among the synthetic esters are those made from polycarboxylic acids and monohydric alochols. More preferred are the ester fluids made by fully esterifying pentaerythritol, or mixtures thereof with di- and tripentaerythritol, with an aliphatic monocarboxylic acid containing from 1 to 20 carbon atoms, or mixtures of such acids.

A wide variety of thickening agents can be used in the greases of this invention. Included among the thickening agents are alkali and alkaline earth metal soaps of fatty acids and fatty minerals having from about 12 to about 30 carbon atoms per molecule. The metals are typified by sodium, lithium, calcium and barium. Fatty materials are illustrated by stearic acid, hydroxystearic acid, stearin, cottonseed oil acids, oleic acid, palmitic acid, myristic acid and hydrogenated fish oils.

Other thickening agents include salt and salt-soap complexes as calcium stearate-acetate (U.S. Pat. No. 2,197,263), barium stearate acetate (U.S. Pat. No. 2,564,561), calcium stearate-caprylate-acetate complexes (U.S. Pat. No. 2,999,065), calcium caprylate-acetate (U.S. Pat. No. 2,999,066), and calcium salt and soaps of low-, intermediate- and high-molecular weight acids and of nut oil acids.

Clays which are useful as starting materials in forming thickening agents to be employed in the grease compositions, can comprise the naturally occurring chemically unmodified clays. The thickening agent is employed in an amount from about 0.5 to about 30, and preferably from 3 to about 15 percent by weight of the total grease composition.

The following examples typify but are not meant in any way to limit the sope of the invention.

EXAMPLE 1

Approximately 46 g of 1,10-decanedicarboxylic acid (commercially obtained from DuPont) and 100 ml of toluene were charged to a stirred reactor equipped with a condenser, thermometer, nitrogen purge inlet and outlet, to which a 50 ml toluene solution of thionyl chloride (50 g) was added dropwise. The mixture was stirred for one hour at 50° C. and then was heated to dissolve all of the solids. A mixed Vanlube NA (100 g, commerically obtained from R. T. Vanderbilt Company, Inc.) and 98 g (di(nonylphenyl) phosphite was then introduced as a very gentle stream. The resulting mixture was heated to reflux for four hours, and then evaporated under vacuum at 130° C. to yield 250 g of clear, reddish brown fluid.

EXAMPLE 2

Under the same reaction conditions as generally described in Example 1, approximately 45.8 g of a mixed 1,8-octanedicarboxylic acid and 1,10-decanedicarboxylic acid (commercially obtained from DuPont) in 100 ml of toluene was reacted with a 50 ml toluene solution of thionyl chloride (50 g). A mixed oleylamine (54 g, commercially obtained from Akzo Chemicals Inc.) and 98 g, di(nonylphenyl) phosphite was then introduced. The final product was 194 g of waxy cream.

EVALUATION OF PRODUCTS

Aliquots of the examples were evaluated using the Catalytic Oxidation Test as shown in Table 1 below. The Catalytic Oxidation Test may be summarized as follows: Basically the lubricant is subjected to a stream of air which is bubbled through the oil formulation at the rate of five liters per hour at 325° F. for 72 hours. Present in the composition are samples of metals commonly used in engine construction, namely iron, copper, aluminum and lead, see U.S. Pat. 3,682,980 incoporated herein by reference for further details.

TABLE 1

| | Catalytic Oxidation Test 325° F., 72 Hours | |
|---|---|---|
| Item | Increase In Acidity Change in Acid Number Δ TAN | Viscosity Increase Percent Change in Viscosity Δ KV, % |
| Base Oil (100% Solvent Paraffinic Neutral Mineral Oil) | 7.78 | 129.4 |
| 1% of Example 1 in above base oil | 0.49 | 9.1 |
| 1% of Example 2 in above base oil | 1.95 | 26.3 |

The Catalytic Oxidation Test results confirm the excellent control in both acidity and viscosity increase. These additives demonstrate remarkable antioxidant properties at only 1% concentration levels.

The antiwear properties of the examples were also evaluated using the Four Ball Wear Test as shown in Table 2. The results clearly exhibit the excellent antiwear properties inherent in these unique compostions.

In the Four Ball Test three stationary balls are placed in a lubricant cup and a lubricant containing the compound to be tested is added thereto, and a fourth ball is placed in a chuck mounted on a device which can be used to spin the ball at known speeds and loads. The examples were tested using half inch stainless steel balls of 5200 steel for thirty minutes under 60 kg load at 2000 rpm and 200° F. If additional information is desired consult test method ASTM D2266 and/or U.S. Pat. No. 4,761,482.

TABLE 2

| Four-Ball Wear Test 60 Kg, 200° F., 2000 rpm, 30 min. | |
|---|---|
| Item | Wear Scar Diameter (mm) |
| Base Oil (80 Solvent Paraffinic Bright, 20% Solvent Paraffinic Neutral Mineral Oils | 1.91 |
| 1% of Example 1 in above base oil | 0.86 |
| 1% of Example 2 in above base oil | 0.63 |

The Four-Ball Wear Test results again demonstrate the excellent antiwear properties of these compositions when used at only 1% concentration in mixed mineral oils.

Reaction products of diacyl chlorides with amines and diaryl phophites exhibit outstanding performance as multifunctional antioxidant (Table 1) and antiwear (Table 2) lubricant additives in lubricants.

The invention and its broader aspects is not limited to the specific details shown and described. Although the invention has been described with preferred embodiments, it is to be understood that modifications and variations may be made without departing from the spirit and scope of the invention as those skilled in the art will readily understand.

What is claimed is:

1. A lubricant composition comprising a major proportion of an oil of lubricating viscosity or grease or other solid lubricant prepared thereform and a minor multifunctional antioxidant, antiwear or load carrying or extreme pressure amount of an additive product comprising the reaction product of diacyl generating species or mixtures of such species having from 0 to about 80 carbon atoms with $C_6$ to about $C_{60}$ hydrocarbyl amines and organic phosphites.

2. The composition of claim 1 wherein the diacyl generating species has the following generalized structure;

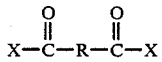

where R is from 0 to about 80 carbon atoms or R is from 0 to about 80 carbon atoms containing sulfur, oxygen or nitrogen or mixtures thereof, and X is halide selected from bromide, chloride, fluoride and iodide.

3. The composition of claim 2 wherein X is chloride.

4. The composition of claim 1 wherein said amine is selected from primary and secondary aliphatic and aromatic amines, alkylaryl amines, arylalkyl amines, alkoxylated polyalkoxylated aliphatic amines, or mixtures thereof.

5. The composition of claim 4 wherein said amine is oleylamine.

6. The composition of claim 4 wherein said amine is alkylated diphenylamine.

7. The composition of claim 1 wherein said phosphite is an alkylated diaryl phosphite.

8. The composition of claim 7 wherein said phosphite is di(nonylphenyl) phosphite.

9. The composition of claim 1 wherein the diacyl halide is the reaction product of 1,10-decanedicarboxylic acid and thionyl chloride, the amine is alkylated diphenylamine and the phosphite is di(nonylphenyl) phosphite.

10. The composition of claim 1 wherein the diacyl halide is the reaction product of mixed 1,10-decanedicarboxylic and 1,8-octanedicarboxylic acids and thionyl chloride, the amine is oleylamine and the phosphite is di(nonylphenyl) phosphite.

11. The composition of claim 1 wherein the lubricant is selected from the group consisting of (1) mineral oils (2) synthetic oils or mixture of synthetic oils, (3) a mixture of (1) and (2) and (4) a grease prepared from (1), (2), or (3).

12. The composition of claim 11 wherein the lubricant is a mineral oil as defined in (1).

13. The composition of claim 11 wherein the lubricant is a synthetic oil as defined in (2).

14. The composition of claim 11 wherein the lubricant is a mixture of oils defined by (3).

15. The composition of claim 11 wherein the lubricant is a grease or other solid lubricant prepared from any of (1), (2) or (3).

16. A one-pot, two step process for making a product of reaction suitable for use as a lubricant additive comprising (1) reacting an aliphatic dicarboxylic acid with a thionyl halide in a molar ratio of acid to halide of from 3:1 to 1:3 at temperatures varying from 0° C. to about 120° . for a time sufficient to obtain the resultant intermediate product, the corresponding diacyl halide and thereafter (2) reacting in situ said diacyl halide and a suitable diaryl phosphite and a hydrocarbyl amine.

17. The process of claim 16 wherein the diacyl generating species has the following generalized structure:

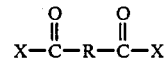

where R is $C_0$ to about $C_{80}$ hydrocarbyl or R is $C_0$ to about $C_{80}$ hydrocaryl containing sulfur, nitrogen or oxygen or mixtures thereof, and X is halide selected from bromide, chloride, fluoride and iodide.

18. The process of claim 17 wherein X is chloride.

19. The process of claim 16 wherein said amine is selected from primary and secondary aliphatic and aromatic amines, alkylaryl amines, arylalkyl amines, alkoxylated polyalkoxylated aliphatic amines, or mixtures thereof.

20. The process of claim 19 wherein said amine is oleylamine.

21. The process of claim 19 wherein said amine is alkylated diphenylamine.

22. The process of claim 16 wherein said phosphite is an alkylated diaryl phosphite

23. The process of claim 22 wherein said phosphite is di(nonylphenyl) phosphite.

24. The process of claim 16 wherein said product is the reaction product of (1) 1,10-decanedicarboxylic acid and thionyl chloride and (2) the resultant diacyl chloride and di(nonylphenyl) phosphite and alkylated diphenylamine.

25. The process of claim 16 wherein said product is the reaction product of (1) mixed 1,8-octanedicarboxylic and 1,10-decanedicarboxylic acids and thionyl chloride and (2) the resultant diacyl chloride and di(nonylphenyl) phosphite and oleylamine.

26. A lubricating additive product prepared by (1) reacting a dicarboxylic acid with a thionyl halide in 3:1 to 1:3 molar ratio at temperatures varying from 0° C. to about 120° C. and (2) thereafter reacting the product of (1) a diacyl halide in situ with a suitable diaryl phosphite and an amine at temperature varying from ambient up to reflux and recovering said desired product.

27. The additive product of claim 26 wherein the diacyl generating species has the following generalized structure:

$$X-\overset{O}{\overset{\|}{C}}-R-\overset{O}{\overset{\|}{C}}-X$$

where R is $C_0$ to about $C_{80}$ hydrocarbyl or R is $C_0$ to about $C_{80}$ hydrocaryl containing sulfur, nitrogen or oxygen or mixtures thereof, and X is halide selected from bromide, chloride, fluoride, fluoride and iodide.

28. The additive product of claim 27 wherein X is chloride and the dicarboxylic acid is a thermal dicarboxylic acid.

29. The additive product of claim 26 wherein said amine is selected from primary and secondary aliphatic and aromatic amines, alkylaryl amines, arylalkyl amines, akoxylated polyalkoxylated aliphatic amines, or mixtures thereof.

30. The additive product of claim 29 wherein said amine is oleylamine.

31. The additive product of claim 29 wherein said amine is alkylated diphenylamine.

32. The additive product of claim 26 wherein said phosphite is an alkylated diaryl phosphite.

33. The additive product of claim 32 wherein said phosphite is di(nonylphenyl) phosphite.

34. The product of claim 26 wherein the step (1) reactants are 1,10-decanedicarboxylic acid and thionyl chloride and the step (2) reactants are the resultant diacyl chloride, di(nonylphenyl) phosphite and oleylamine.

35. The product of claim 26 wherein the step (1) reactants are mixed, 1,10-decanedicarboxylic acid and 1,8-octanedicarboxylic acid and thionyl chloride; and the step (2) reactants are the resultant diacyl chloride, di(nonylphenyl) phosphite and alkylated diphenylamine.

36. A method of reducing wear and fuel consumption in an internal combustion engine which comprises lubricating said engine with a composition comprising a major proportion of a lubricating oil and a fuel reducing multifunctional additive amount of a product of reaction obtained by reacting a dicarboxylic acid with a thionyl halide in 3:1 to 1:3 molar ratio of acid to halide, at temperatures varying from 0° C. to 120° C and thereafter reacting the resultant intermediate product in situ with a suitable diaryl phosphite and amine at temperatures varying from ambient up to reflux and recovering said desired product.

37. The method of claim 36 wherein said thionyl halide is thionyl chloride acid said dicarboxylic acid is a terminal dicarboxylic acid.

* * * * *